US009481541B2

(12) United States Patent
Cugnoni

(10) Patent No.: US 9,481,541 B2
(45) Date of Patent: Nov. 1, 2016

(54) NON-STOP RACK DEVICE FOR A CONVERTING MACHINE

(71) Applicant: BOBST MEX SA, Mex (CH)

(72) Inventor: Daniel Cugnoni, Corseaux (CH)

(73) Assignee: BOBST MEX SA (CH)

( * ) Notice: Subject to any disclaimer, the term of this patent is extended or adjusted under 35 U.S.C. 154(b) by 36 days.

(21) Appl. No.: 14/388,355

(22) PCT Filed: Mar. 27, 2013

(86) PCT No.: PCT/EP2013/000911
§ 371 (c)(1),
(2) Date: Sep. 26, 2014

(87) PCT Pub. No.: WO2013/143690
PCT Pub. Date: Oct. 3, 2013

(65) Prior Publication Data

US 2015/0050113 A1 Feb. 19, 2015

(30) Foreign Application Priority Data

Mar. 28, 2012 (EP) ..... 12002250

(51) Int. Cl.
*B65H 31/32* (2006.01)

(52) U.S. Cl.
CPC ..... *B65H 31/32* (2013.01); *B31B 2201/927* (2013.01); *B65H 2301/4212* (2013.01); *B65H 2405/323* (2013.01); *B65H 2553/43* (2013.01);
(Continued)

(58) Field of Classification Search
CPC ..... B65H 2405/323; B65H 31/32; H01L 21/67742; B65G 49/067
USPC ..... 269/296; 271/218; 294/119.1, 213; 414/217, 667, 790.2, 790.8, 794.1, 414/939, 941; 901/30
See application file for complete search history.

(56) References Cited

U.S. PATENT DOCUMENTS 6,058,990 A * 5/2000 Kent ..... B25H 1/10 144/1.1
6,752,586 B2 * 6/2004 Baumann ..... B65H 31/32 271/218

(Continued)

FOREIGN PATENT DOCUMENTS

DE 4216123 A1 * 11/1993 ..... B65H 31/20
DE 10 2011 000583 A1 2/2012

(Continued)

OTHER PUBLICATIONS

International Search Report dated Jul. 4, 2013 issued in corresponding International patent application No. PCT/EP2013/000911.

*Primary Examiner* — Gregory Adams
(74) *Attorney, Agent, or Firm* — Ostrolenk Faber LLP

(57) ABSTRACT

A non-stop rack device for temporary receipt of the flat elements in the form of sheets in a converting machine, the device comprising a plurality of parallel bars which are integral with a mobile support which can be displaced between a receipt position, in which the bars can support temporarily the flat elements which are being stacked, and a released position, in which the said bars are placed spaced from any stack of flat elements. Each non-stop bar is mounted so as to be mobile in transverse displacement relative to the mobile support, and the non-stop rack device also comprises a blocking arrangement, which can block the transverse mobility of each non-stop bar.

18 Claims, 5 Drawing Sheets

(52) U.S. Cl.
CPC ..... *B65H 2553/52* (2013.01); *B65H 2557/13* (2013.01); *B65H 2701/1764* (2013.01)

(56) References Cited

U.S. PATENT DOCUMENTS 6,871,893 B2 * 3/2005 Langston ..... B65G 61/00 294/113
7,401,828 B2 * 7/2008 Yang ..... B65G 49/061 294/119.1
7,628,575 B2 * 12/2009 Gammerler ..... B65G 47/902 294/103.1
2001/0053393 A1 12/2001 Baumann et al.
2012/0031438 A1 * 2/2012 Jheong ..... B65G 65/00 134/32
2013/0140763 A1 6/2013 Jakob

FOREIGN PATENT DOCUMENTS

EP 1 153 871 A2 11/2001
JP 1995-257806 10/1995

* cited by examiner 1
12
18
13
42
43
44
10
19
15
16
11
41
14
17
40
30
31
20

19
14a
12
14
18
13
11
10
15
16
1
17
41
43
30
31
42
44
40

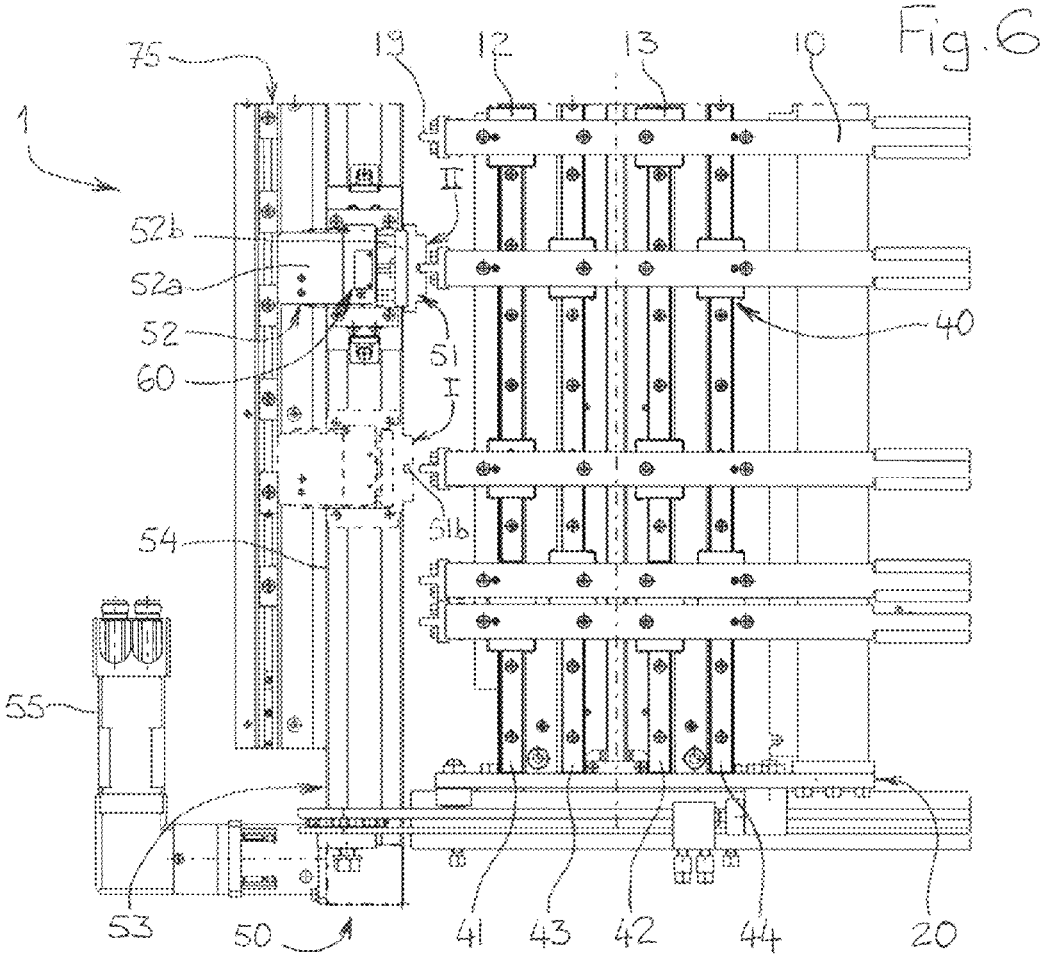
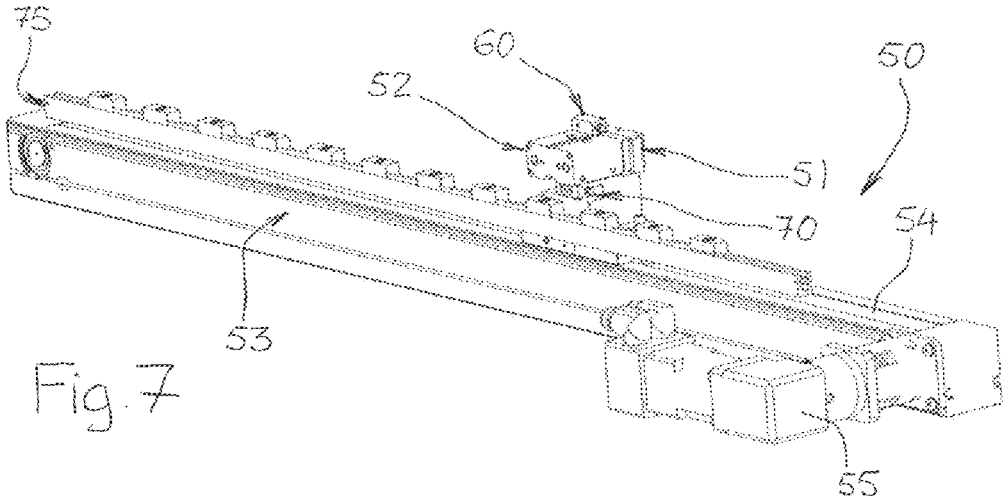
Fig. 7

NON-STOP RACK DEVICE FOR A CONVERTING MACHINE

CROSS-REFERENCE TO RELATED APPLICATIONS

The present application is a 35 U.S.C. §§371 national phase conversion of PCT/EP2013/000911, filed Mar. 27, 2013, which claims priority of European Patent Application No. 12002250.4, filed Mar. 28, 2012, the contents of which are incorporated by reference herein. The PCT International Application was published in the French language.

FIELD OF THE INVENTION

The present invention relates to a device which makes it possible to temporarily receive flat elements in the form of sheets, while the sheets are being stacked in a converting machine. The device has a particularly advantageous, but not exclusive application in the field of production of cardboard packaging.

BACKGROUND

In the industry, folding boxes are traditionally manufactured by folding and gluing of blanks which have previously been formed from sheets of cardboard. Forming in this way generally consists in pre-cutting the sheets in question individually, discharging the waste, then separating the blanks which constitute each sheet, while proceeding progressively to stack these blanks for the purpose of making them easy to use in a folding and gluing machine. The step of separation of blanks conventionally consists in breaking the points of attachment which connect the blanks, by means of the combined action of a male upper tool and a female lower tool which are specific to the work to be carried out.

In order to guarantee the stability of the different stacks of blanks at the end of the forming process, it is known to proceed with periodic insertion of a separation sheet during the final stacking, by inserting a separation sheet each time a certain number of blanks has been stacked. In order for this insertion to be carried out without needing complete stoppage of the converting machine, use is habitually made of a temporary receipt device which is commonly known as a non-stop grid or rack.

A typical non-stop rack in the art consists schematically of a mobile carriage on which a plurality of parallel bars are mounted. These parallel bars are arranged longitudinally inside the converting machine, in order to form a type of rack which can penetrate the fixed tool for separation of blanks, but can also receive the blanks. Each bar is also mounted on the carriage such as to be able to be withdrawn or repositioned transversely according to the profile of the fixed tool for separation of blanks. The carriage, for its part, is mounted such as to be mobile in longitudinal displacement within the converting machine, according to a movement of alternating translation. The assembly is designed such that this mobility is exerted between a receipt position, in which the bars can support temporarily the blanks which are being stacked, and a released position, in which the said bars are placed spaced from any stack.

However, this type of non-stop rack has the disadvantage that it is relatively problematic to adjust. In fact, each bar repositioning, which consists in unlocking in the initial position, then displacement to the final position, before locking once more once the said final position has been reached, must be carried out both manually and individually.

However, the implantation of the non-stop rack at the heart itself of the converting machine makes the bars difficult to access, which inevitably complicates any manual intervention by the operator. The fact that each non-stop bar must be repositioned individually tends, for its part, to increase the number of the operations of unlocking, displacement and locking, and therefore to generate adjustment times which are particularly long. Finally, it is complicated to obtain optimum precision of adjustment, taking into account the lack of visibility of the bars, caused by the implantation of the non-stop rack inside the converting machine.

Thus, a technical problem to be solved relates to provision of a non-stop rack device for temporary receipt of the flat elements in the form of sheets in a converting machine, the said device comprising a plurality of parallel bars which are integral with a mobile support which can be displaced between a receipt position, in which the bars can support temporarily the flat elements which are being stacked, and a released position, in which the said bars are placed spaced from any stack of flat elements, which device would make it possible to avoid the problems which exist in the art, by providing in particular adjustment which is substantially facilitated.

SUMMARY

According to an embodiment of the present invention, the technical problem may be solved by mounting each non-stop bar so as to be mobile in transverse translation relative to the mobile support, and by providing the non-stop rack device with a blocking arrangement which can block the transverse mobility of each non-stop bar.

It will be appreciated that throughout this text, the concept of a flat element designates very generally any body which is flat and has a narrow thickness, independently of its contour, format, or the material which constitutes it. Reference is made for example to a whole sheet, a pre-cut sheet, an assembly of blanks or cut-outs which are attached in a localized manner to one another, or an individual cut-out or blank obtained after an operation of separation of blanks, etc. According to this logic, a flat element of this type can be made of any material, and in particular of paper, fiberboard, corrugated cardboard, plastic material, etc.

It is also important to specify that the terms which are designed to define positioning in space, such as "longitudinal", "transverse", "front" or "rear", are understood relative to the axis of the converting machine, i.e. to the direction and sense according to which the forming of the flat elements takes place.

The device as thus defined has the advantage of providing a design which is compatible with mechanization, or even with automation of the adjustment of the non-stop bars. This makes it possible to simplify significantly the interventions of the operator, and thus ultimately to reduce the adjustment time considerably. However, this also contributes towards improving significantly the precision of the adjustment, as well as the reliability of the non-stop rack as a whole.

Further aspects of the invention relate to characteristics which will become apparent from the following description, and which must be considered in isolation or according to all their possible technical combinations. This description, which is provided by way of non-limiting example, is designed to provide better understanding of what constitutes the invention, and how it can be implemented.

BRIEF DESCRIPTION OF THE DRAWINGS

The description is also provided with reference to the attached drawings in which:

FIG. 6 is a plan view which illustrates the co-operation between the non-stop bars and their actuating means.

FIG. 7 represents the actuating means of the non-stop bars, in rear perspective.

For reasons of clarity, the same elements have been designated by identical references. Similarly, only the elements which are essential for the understanding of the invention have been represented, without respect for scale, and schematically.

DESCRIPTION

Figure 1:
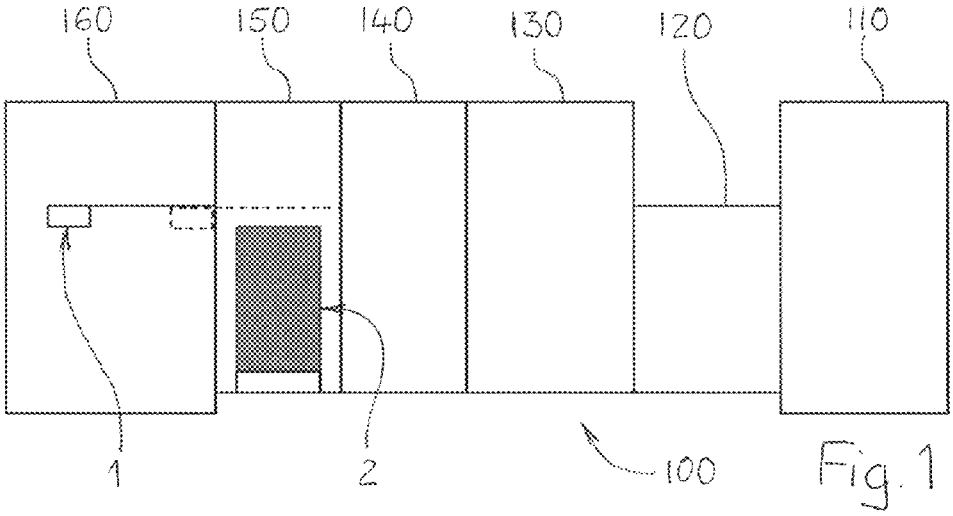
FIG. 1 illustrates a converting machine (forming machine) in which a non-stop rack device is incorporated.

FIG. 1 illustrates a converting machine 100, the function of which is to cut out blanks from a succession of sheets of cardboard. These blanks are designed to be folded and glued subsequently, in order to constitute packaging boxes. Since a converting machine 100 of this type is perfectly known in the art, it will not be described in detail here, at the level either of its structure or its functioning.

It will simply be recalled that the machine conventionally consists of a plurality of work stations 110, 120, 130, 140, 150, 160, which are juxtaposed in order to form a unit assembly which can process a succession of sheets. Thus, it includes a feeder 110 which is responsible for feeding the machine sheet by sheet, then a feed table 120 on which the sheets are layered before being positioned individually with precision, and a cutting station 130 which carries out its function by means of a platen press. It will be noted that there is also present an stripping station 140 which makes it possible to remove the waste which is produced directly during the cutting of the sheets, a delivery station 150 with separation of blanks, the role of which station is to break the points of attachment which join the blanks to one another, in order to separate the blanks, then to repack them in stacks so that they can be used directly in a folding and gluing machine, and finally a discharge station 160, from which the residual waste is discharged. It will be appreciated that transport means (not shown) are provided in order to displace each sheet individually from the output of the feed table to the delivery station.

Figure 2:
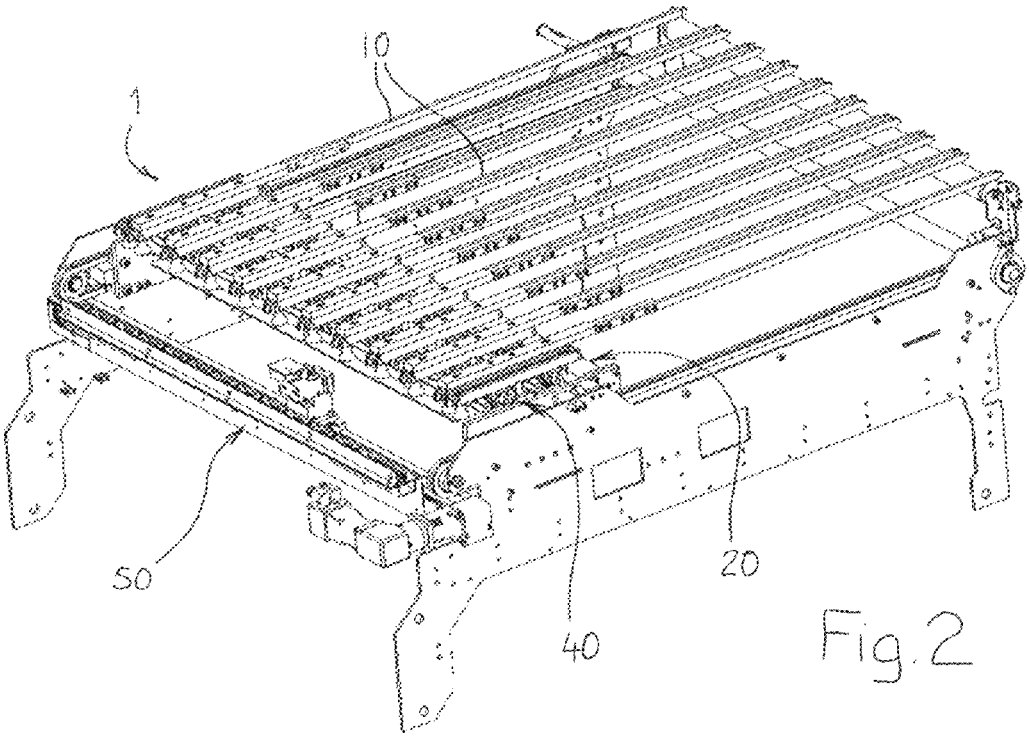
FIG. 2 is a plan view in perspective which represents the non-stop rack device in the released position.
Figure 3:
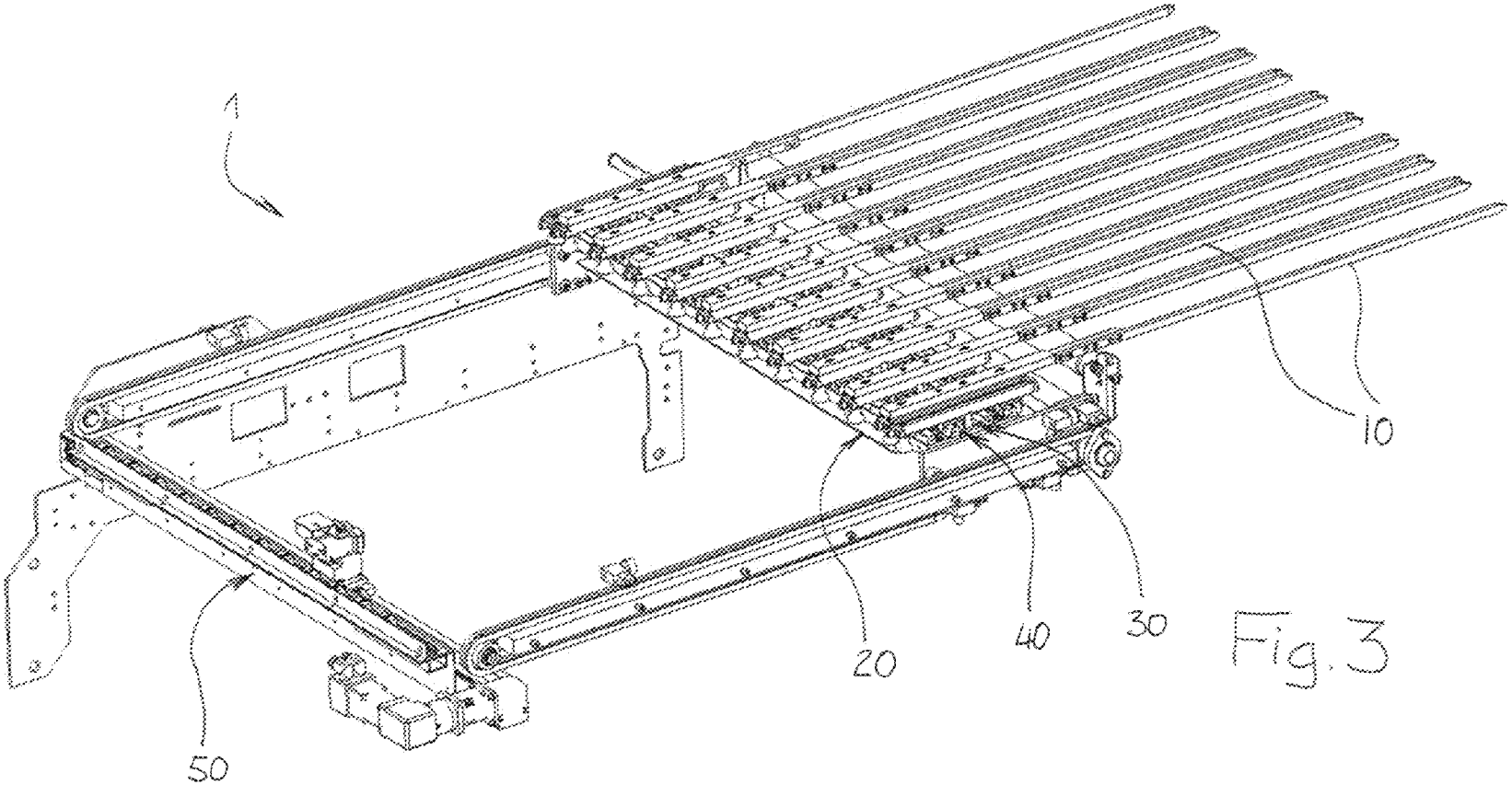
FIG. 3 constitutes a view similar to FIG. 2, but with the non-stop rack device in the receipt position.

FIG. 1 also shows that the converting machine 100 incorporates a non-stop rack device 1, which makes it possible to receive the blanks 2 temporarily at the end of the forming process, i.e. when the blanks are stacked. For this purpose, and as can be seen more clearly in FIGS. 2 and 3, the non-stop rack device 1 is provided with a plurality of parallel bars 10, which are arranged longitudinally, and are integral with a mobile support 20, which can be displaced according to the axis of the converting machine 100. This mobility is exerted between a receipt position, in which the non-stop bars 10 can support temporarily the blanks 2 which are being stacked (device 1 in broken lines in FIG. 1 and FIG. 3), and a released position in which the said bars 10 are spaced from any stack of blanks 2 (device 1 in a solid line in FIG. 1 and FIG. 2).

Each non-stop bar 10 is mounted such as to be mobile in transverse displacement relative to the mobile support 20. In addition, the non-stop rack device 1 is also provided with blocking means 30, which can immobilize each non-stop bar 10 transversely in a position specific to it. Contrary to their equivalents in the art, each non-stop bar 10 is therefore not simply mounted in a detachable manner, so that it can be removed then replaced in an appropriate transverse position, but it is mounted such as to be mobile, in order to be able to be translated transversely to the required position.

According to a particular feature, the non-stop rack device 1 has guide means 40 which can guide each non-stop bar 10 in transverse translation relative to the mobile support 20. It should be noted that at this stage of the description, and although in this case above all a sliding assembly is taken into consideration, any other guide technique known in the art could be used in an equivalent manner in order to guide the transverse translation of each non-stop bar 10.

Whatever the case, in this particular embodiment, selected purely by way of example, each non-stop bar 10 is integral with two carriages 12, 13 mounted such as to slide respectively along two parallel guide rails 41, 42; 43, 44, which are secured transversely on the mobile support 20; the said carriages 12, 13, associated with the said guide rails 41, 42; 43, 44, forming the guide means 40. The use of two spaced rails 41, 42; 43, 44 per non-stop bar 10 makes it possible to optimize the guide function, by opposing the natural tendency of the said bar 10 to pivot angularly under the effect of its long length and its cantilevered implantation.

Figure 4:
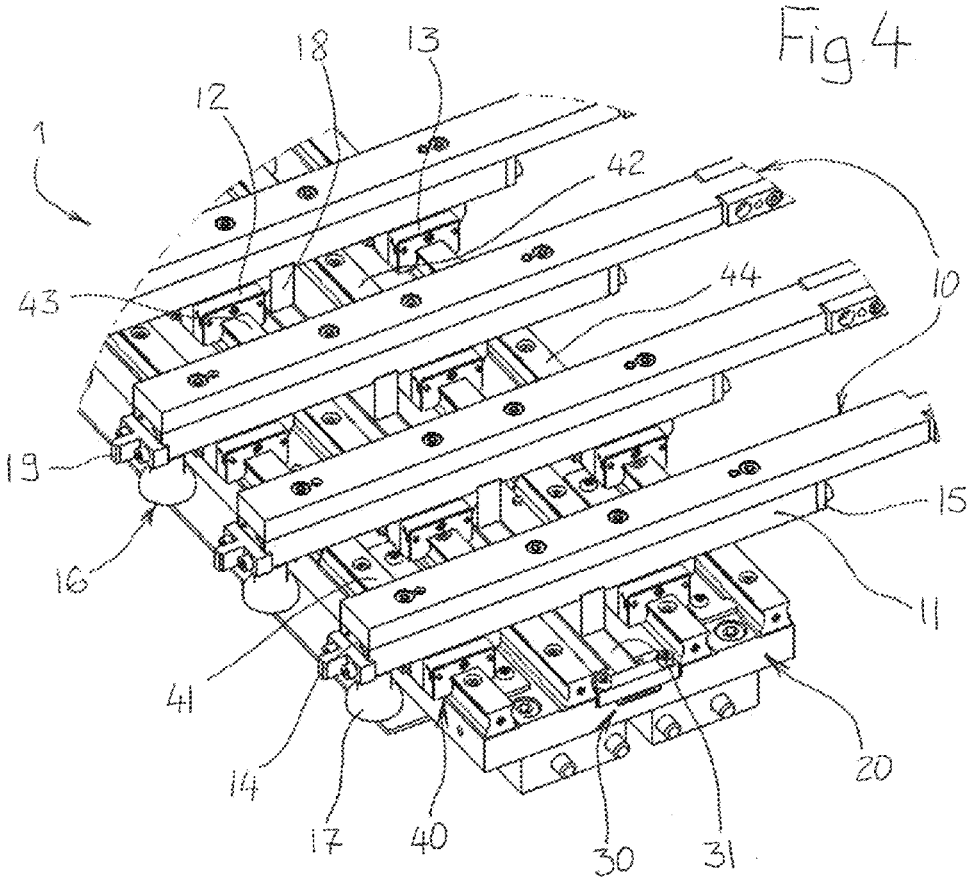
FIG. 4 shows in detail the implantation of the bars on the mobile part of the non-stop rack device.
Figure 5:
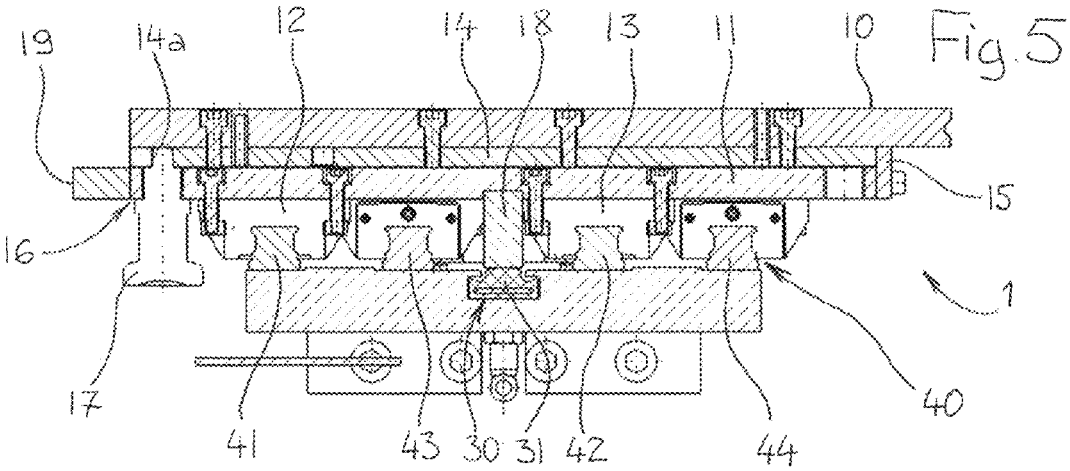
FIG. 5 shows the mobile part of the non-stop rack device, in longitudinal cross-section.

As can be seen clearly in FIGS. 4 to 6, the guide means 40 in this case comprise only two pairs of guide rails 41, 42; 43, 44, which co-operate respectively and alternately with one non-stop bar 10 out of two. In other words, this means that two directly adjacent non-stop bars 10 are each guided transversely by distinct pairs of rails 41, 42; 43, 44. The advantage of a configuration of this type is to permit staggered positioning of the directly adjacent carriages 12, 13. Ultimately, this makes it possible to bring the non-stop bars 10 as close as possible to one another, despite the fact that these guide carriages 12, 13 have a width which is far greater than that of the said bars 10.

Preferably, the guide rails 41, 42; 43, 44 of each pair of rails are positioned alternately relative to the guide rails 41, 42; 43, 44 of the other pair of rails. Thus, going from the front to the rear, there are in succession a first rail 41 of a first pair of rails, a first rail 43 of the other pair, the second rail 42 of the first pair of rails, and finally the second rail 44 of the other pair. An arrangement of this type makes it possible to standardize the distance which separates the two areas at the level of which each non-stop bar 10 is connected to the mobile support 20, resulting in homogenization of the guide function.

In a particularly advantageous manner, each non-stop bar 10 is mounted such as to be detachable relative to a body 11 integral with the two carriages 12, 13, which are responsible for the transverse sliding of the said bar 10. This characteristic serves the purpose of facilitating the withdrawal of any non-stop bar 10, the presence of which is not necessary, or the replacement of such a bar by a model with a more appropriate structure and/or form and/or dimensions.

In practice, each non-stop bar 10 can fit together, according to a longitudinal direction, with the body 11 which is associated with it. According to this logic, the non-stop rack device 1 is additionally provided with locking means 16 which can block the mobility of each non-stop bar 10 according to its direction of fitting together. The immobilization of each non-stop bar 10 is thus derived from the combined action of fitting together which generates its transverse retention, and locking which generates its longitudinal retention.

In detail, the lower part of each non-stop bar 10 is integral with an element in the form of an inverted "T", which forms a tenon 14. The latter can be inserted in a groove with a substantially complementary form, which is provided longitudinally relative to the upper part of the body 11. A stop plate 15 is secured to the end of the body 11, in order to limit the insertion of the tenon 14 in the groove.

For their part, the locking means 16 are constituted, for each body 11, by a finger 17 which is mounted such as to be mobile in displacement relative to the body 11, according to a direction at right angles relative to the non-stop bar 10. This mobility is exerted between an active position, in which the end of the finger 17 is engaged in a blocking hole 14*a* provided through the tenon 14 (FIG. 5), and a passive position in which the said end is spaced from the said blocking hole 14*a*. A spring (not shown), which acts as a resilient return means, is conventionally provided in order to drive the finger 17 continually into the active position.

According to another advantageous characteristic, the non-stop rack device 1 is designed such that an intermediate body (not represented) which forms a spacer, can be interposed between each non-stop bar 10 and the body 11 which is associated with it. This characteristic provides the possibility of adapting the height of the rack according to the thickness and/or quantity of the flat elements 2 to be received.

According to another particular feature, the blocking means 30 are provided with at least one contact unit 31 which can press against at least one non-stop bar 10, in order to block the transverse mobility of each of the bars by means of static friction. It is important to note here that within the context of implementation of this blocking function, it will be appreciated that the concept of non-stop bar 10 extends to the bar itself, but also to any element with which the said bar 10 remains integral in the case of transverse displacement. Reference is made in particular to the body 11, or to any intermediate part which acts as an interface.

Particularly advantageously, each contact unit 31 is constituted by a resiliently deformable element which can be expanded between a passive position and an active position. The assembly is designed such that, in the passive position, each contact unit 31 is kept away from any non-stop bar 10, which can thus be displaced transversely, but such that, in the active position, each contact unit 31 is pressed against at least one non-stop bar 10, the displacement of which is therefore immobilized.

Preferably, each resiliently deformable element has a hollow structure which can be expanded when a pressurized fluid is injected into its interior.

According to an embodiment of the invention which is currently preferred, the blocking means 30 in this case comprise a single contact unit 31, which is arranged substantially transversely, and can immobilize all the non-stop bars 10 simultaneously. As can be seen clearly in FIG. 5, this contact unit 31 has a hollow structure which can be resiliently deformed under the effect of an injection of compressed air, which naturally implies the presence upstream of a pneumatic supply source (not represented). In practice, the contact unit 31 fulfills its blocking function on each non-stop bar 10 by pressing against a block 18 which is rendered integral below each body 11.

It has previously been seen that in this embodiment, the transverse displacement of each non-stop bar 10 is guided by two parallel rails 41, 42; 43, 44, which are positioned spaced from one another. According to this logic, the assembly is designed such that the blocking means 30 exert their action at the level of the part of each non-stop bar 10 which extends between the two guide rails 41, 42; 43, 44. An arrangement of this type is above all designed to optimize the efficiency of the blocking means 30.

The non-stop rack device 1 previously described constitutes to some extent a manual variant, in the sense that, although the unlocking and locking of the different non-stop bars 10 can be automated, their individual displacements must nevertheless be carried out manually.

However, it appears perfectly possible to conceive of a fully motorized variant, in which the location of the positions and the displacement of the non-stop bars 10 would also be automated. Thus, according to another particular feature, the non-stop rack device 1 in the embodiment described additionally comprises actuating means 50 which can displace each non-stop bar 10 in an automated manner along the mobile support 20, when the blocking means are not operative.

Figure 8:
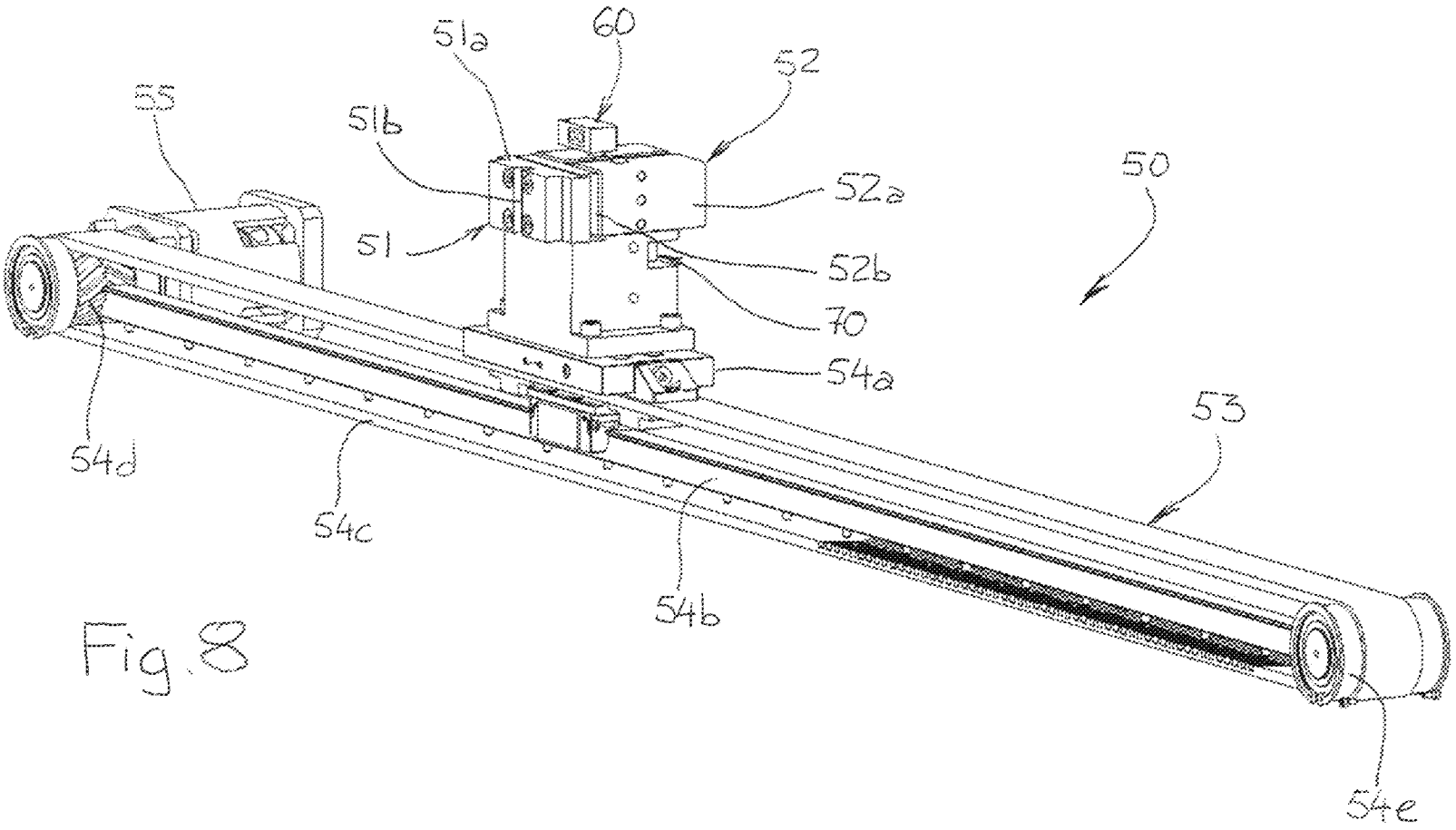
FIG. 8 shows in cross-section the inner structure of the actuating means.

As can be seen in FIGS. 6 to 8, the actuating means 50 comprise firstly a coupling element 51 which is formed such as to be able to co-operate by fitting together with a substantially complementary part of each non-stop bar 10. It can also be seen that the actuating means 50 are additionally provided with a first actuator 52, which can displace the coupling element 51 between a position of withdrawal (representation I in a broken line in FIG. 6) in which it is kept spaced from the different non-stop bars 10, and a coupling position (representation II in a solid line) in which it can be fitted together with any non-stop bar 10 which is positioned directly facing it. Finally, the actuating means 50 are provided with a second actuator 53, which can displace the coupling element 51 along the entire width of the mobile support 20, such as to be able either to position the said coupling element 51 facing any non-stop bar 10, or to displace transversely any non-stop bar 10 which is fitted together with the coupling element 51. It will be appreciated that, in order for each non-stop bar 10 to be able to be displaced, the direction of fitting together of the coupling element 51 must be substantially perpendicular to the direction of transverse displacement of the said non-stop bar 10.

In this embodiment, the coupling element 51 consists of a block 51*a*, on the outer surface of which there is provided a female recess 51*b* which is formed such as to be able to fit together with a projecting fin 19 secured to the end of each non-stop bar 10 (FIG. 6).

The first actuator 52, for its part, is constituted by a pneumatic jack 52*a*, the mobile part 52*b* of which is integral with the coupling element 51. Its mobility is exerted parallel to the axis of the converting machine 100, consequently generating longitudinal fitting together between the coupling element 51 and any fin 19 placed facing it.

The second actuator 53, for its part, consists of the association of a linear unit 54 of the "toothed belt axis" type, and a gear motor 55. The mobile part of the linear unit supports the first actuator 52. Its mobility is exerted perpendicularly to the axis of the converting machine 100, thus permitting the transverse displacement of the coupling element 51.

According to FIG. 8, the mobile part of the linear unit 54 is conventionally in the form of a carriage 54*a* which is mounted such as to slide along a guide rail 54*b*. In order to be able to be displaced, this carriage 54*a* is rendered integral with a toothed belt 54*c*, which is stretched between two pulleys 54*d*, 54*e*, one of which is coupled in a driving manner with the gear motor 55.

According to the logic for complete automation of the process of regulation of the non-stop rack device 1, it appears essential to know the initial positions and the final positions of the different non-stop bars 10, i.e. the positions before and after the individual displacements of the said bars 10. This is why the non-stop rack device 1 is in this case advantageously provided with first detection means 60, which are responsible for locating the initial position of each non-stop bar 10 relative to the mobile support 20. In this embodiment, the first detection means 60 consist of a laser cell which is secured to the first actuator 52, and is aimed rearwards parallel to the axis of the converting machine 100, at the level of the bodies 11 which support the non-stop bars 10.

It is also known that in the embodiment described, the non-stop bars 10 are designed to extend through a tool of the converting machine 100 when they are in the receipt position, in this case the fixed tool for separation of blanks. This is why the non-stop rack device 1 is also provided with a positioning template 75, the profile of which corresponds to that of the tool of the converting machine 100, as well as with second detection means 70 which can locate the theoretical position of each non-stop bar 10, provided by the profile of the said positioning template 75. In this embodiment, the second detection means 70 are constituted by a laser cell which is rendered integral below the first actuator 52 and is aimed forwards parallel to the axis of the converting machine 100, at the level of the rising and descending flanks of the positioning template 75.

In a configuration of this type, the implementation of the first and second detection means 60, 70 can be carried out successively, in one order or the other. However, in practice, it will preferably be carried out simultaneously for obvious reasons of time-saving.

However, it can be noted that it can be envisaged to dispense with the first detection means 60, if it is considered that the initial positions of the non-stop bars 10 before a new job simply correspond to their final positions during the previous job. The use of only the second detection means 70 then appears necessary.

According to a variant embodiment which can be used when the non-stop bars 10 are designed to extend through a tool of the converting machine 100, when they are in the receipt position, the non-stop rack device 1 could comprise third detection means which can determine the theoretical position of each non-stop bar 10 directly, according to the transverse profile of the tool. Third detection means of this type (not represented) could associate a laser cell which is integral with the first actuator 52 and is aimed rearwards, with a rear reflector element which is secured to the base of the delivery station 150, and faces forwards.

It will be appreciated that the invention concerns more generally any converting machine 100 for flat elements 2 in the form of sheets, which comprises at least one non-stop rack device 1 as previously described.

The invention claimed is:

1. Non-stop rack device for temporary receipt of flat elements in the form of sheets in a converting machine, the device comprising a plurality of parallel bars which are integral with a mobile support which is displaceable between a receipt position, in which the bars can support temporarily the flat elements which are being stacked, and a released position, in which the bars are placed spaced from any stack of flat elements, characterized in that each non-stop bar is mounted such as to be mobile in transverse displacement relative to the mobile support, in that the non-stop rack device also comprises a blocking arrangement, which can block the transverse mobility of each non-stop bar, and in that the blocking arrangement comprises at least one contact unit which can press against at least one non-stop bar, in order to block any transverse mobility by means of static friction.

2. Non-stop rack device according to claim 1, characterized in that it comprises a guide arrangement which can guide each non-stop bar in transverse translation relative to the mobile support.

3. Non-stop rack device according to claim 1, characterized in that each contact unit is constituted by a resiliently deformable element which can be expanded between a passive position in which it is kept away from any non-stop bar, and an active position, in which it is pressed against at least one non-stop bar.

4. Non-stop rack device according to claim 3, characterized in that each resiliently deformable element has a hollow structure which can be expanded when a pressurized fluid is injected into its interior.

5. Non-stop rack device according to claim 1, characterized in that the blocking arrangement comprises a single contact unit, which is arranged substantially transversely, and can immobilize all the non-stop bars simultaneously.

6. Non-stop rack device according to claim 1, characterized in that the transverse displacement of each non-stop bar is guided by two parallel rails which are positioned spaced from one another, and the blocking arrangement exerts its action on the part of each non-stop bar which extends between the two guide rails.

7. Non-stop rack device according to claim 1, characterized in that it comprises an actuating arrangement which can displace each non-stop bar in an automated manner relative to the mobile support, when the blocking arrangement is not operative.

8. Non-stop rack device according to claim 7, characterized in that the actuating arrangement comprises a coupling element which can co-operate by fitting together with a part of each non-stop bar, a first actuator, which can displace the coupling element between a position of withdrawal in which it is kept spaced from any non-stop bar, and a coupling position, in which it can be fitted together with each non-stop bar, as well a second actuator, which can displace the coupling element along the entire width of the mobile support.

9. Non-stop rack device according to claim 1, characterized in that it comprises a first detector, which can locate an initial position of each non-stop bar relative to the mobile support.

10. Non-stop rack device according to claim 9, characterized in that the non-stop bars are disposed so as to extend through a tool of the converting machine when they are in the receipt position, the non-stop rack device comprises a positioning template, a profile of which corresponds to that of the tool, as well as a second detector which can locate the theoretical position of each non-stop bar, provided by the profile of the said positioning template.

11. Non-stop rack device according to claim 10, characterized in that the non-stop bars are designed to extend through a tool of the converting machine when they are in the receipt position, and the non-stop rack device comprises a third detector which can determine the theoretical position of each non-stop bar directly, according to the transverse profile of the tool.

12. Non-stop rack device for temporary receipt of flat elements in the form of sheets in a converting machine, the device comprising a plurality of parallel bars which are integral with a mobile support which is displaceable between a receipt position, in which the bars can support temporarily the flat elements which are being stacked, and a released position, in which the bars are placed spaced from any stack of flat elements, characterized in that each non-stop bar is mounted such as to be mobile in transverse displacement relative to the mobile support, in that the non-stop rack device also comprises a blocking arrangement, which can block the transverse mobility of each non-stop bar, in that the blocking arrangement comprises at least one contact unit which can press against at least one non-stop bar, in order to block any transverse mobility by means of static friction, in that the non-stop rack device also comprises a guide arrangement which can guide each non-stop bar in transverse translation relative to the mobile support; and in that each non-stop bar is integral with two carriages, which are mounted so as to slide respectively along two parallel guide rails, which are secured transversely on the mobile support, the carriages associated with the said guide rails forming the guide arrangement.

13. Non-stop rack device according to claim 12, characterized in that the guide arrangement comprises two pairs of guide rails, which co-operate respectively and alternately with one non-stop bar out of two non-stop bars.

14. Non-stop rack device according to claim 13, characterized in that the guide rails of each pair of rails are positioned alternately relative to the guide rails of the other pair of rails.

15. Non-stop rack device according to claim 12, characterized in that each non-stop bar is mounted such as to be detachable relative to a body integral with the two carriages which are responsible for the transverse sliding of the said bar.

16. Non-stop rack device according to claim 15, characterized in that each non-stop bar can fit together, according to a longitudinal direction, with the body which is associated with it, and in that the non-stop rack device additionally comprises a locking arrangement which can block the mobility of the said bar according to its direction of fitting together.

17. Non-stop rack device according to claim 15, characterized in that an intermediate body which forms a spacer is interposed between each non-stop bar and the body which is associated with it.

18. Converting machine for flat elements in the form of sheets, characterized in that it comprises at least one non-stop rack device according to claim 1, and at least one additional work station juxtaposed with said non-stop rack device to form a unit assembly for processing a succession of sheets.

* * * * *